US008376060B2

(12) United States Patent
Orr et al.

(10) Patent No.: US 8,376,060 B2
(45) Date of Patent: Feb. 19, 2013

(54) ADJUSTABLE ESCUTCHEON ASSEMBLY FOR A SPRINKLER

(75) Inventors: Shawn G. Orr, Grand Rapids, MI (US); David VanEerden, Middleville, MI (US)

(73) Assignee: The Viking Corporation, Hastings, MI (US)

( * ) Notice: Subject to any disclaimer, the term of this patent is extended or adjusted under 35 U.S.C. 154(b) by 38 days.

(21) Appl. No.: 11/948,487

(22) Filed: Nov. 30, 2007

(65) Prior Publication Data

US 2009/0139735 A1 Jun. 4, 2009

(51) Int. Cl.
*A62C 37/09* (2006.01)

(52) U.S. Cl. ..... 169/37; 239/600; 248/343; 248/344; 362/145

(58) Field of Classification Search ..... 169/37, 169/51, 54; 248/323, 317, 324, 337, 343, 248/344, 342, 340, 288.11, 288.31; 362/145, 362/287; 239/600
See application file for complete search history.

(56) References Cited

U.S. PATENT DOCUMENTS 1,779,936 A * 10/1930 Hess ..... 285/263
1,942,395 A * 1/1934 Bersted ..... 239/391
2,190,532 A * 2/1940 Lukomski ..... 210/164
3,714,989 A * 2/1973 Gloeckler ..... 169/19
3,783,947 A * 1/1974 Dix et al. ..... 169/40
3,815,821 A * 6/1974 Metcalfe ..... 169/37
3,823,964 A * 7/1974 Politz ..... 285/46
3,865,310 A * 2/1975 Elkins et al. ..... 239/283
3,998,273 A * 12/1976 Juliano ..... 169/37
4,085,633 A * 4/1978 Jackson et al. ..... 81/111
4,215,751 A * 8/1980 Mears ..... 169/51
4,770,251 A * 9/1988 Sweet ..... 169/37
4,785,888 A * 11/1988 Blum et al. ..... 169/39
4,872,512 A * 10/1989 Multer ..... 169/51
4,926,946 A * 5/1990 Polan ..... 169/37
5,070,434 A * 12/1991 Suman et al. ..... 362/490
5,139,199 A * 8/1992 Jeffrey et al. ..... 239/222.19
5,447,338 A * 9/1995 Kikuchi ..... 285/46
5,530,223 A * 6/1996 Culzoni et al. ..... 219/401
6,024,177 A * 2/2000 Winebrenner ..... 169/51
6,264,122 B1 * 7/2001 Perdreau et al. ..... 239/600
6,536,809 B2 * 3/2003 Marty et al. ..... 285/261
7,011,439 B1 * 3/2006 Kane et al. ..... 362/554
2004/0065788 A1 * 4/2004 Kirschner ..... 248/75
2005/0184173 A1 * 8/2005 Marty et al. ..... 239/587.4
2007/0292234 A1 * 12/2007 Panasik et al. ..... 411/340

* cited by examiner

*Primary Examiner* — Christopher Kim
*Assistant Examiner* — Trevor E McGraw
(74) *Attorney, Agent, or Firm* — Harness, Dickey & Pierce, P.L.C.

(57) ABSTRACT

An adjustable escutcheon assembly as provided for mounting a sprinkler in a sloped ceiling so that the sprinkler can be mounted parallel to the ceiling and with a refined appearance.

3 Claims, 5 Drawing Sheets

FIG 3
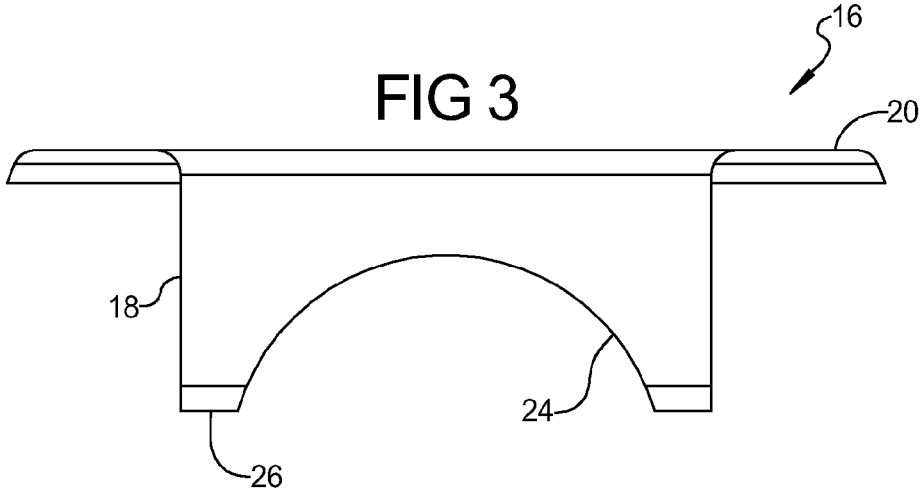
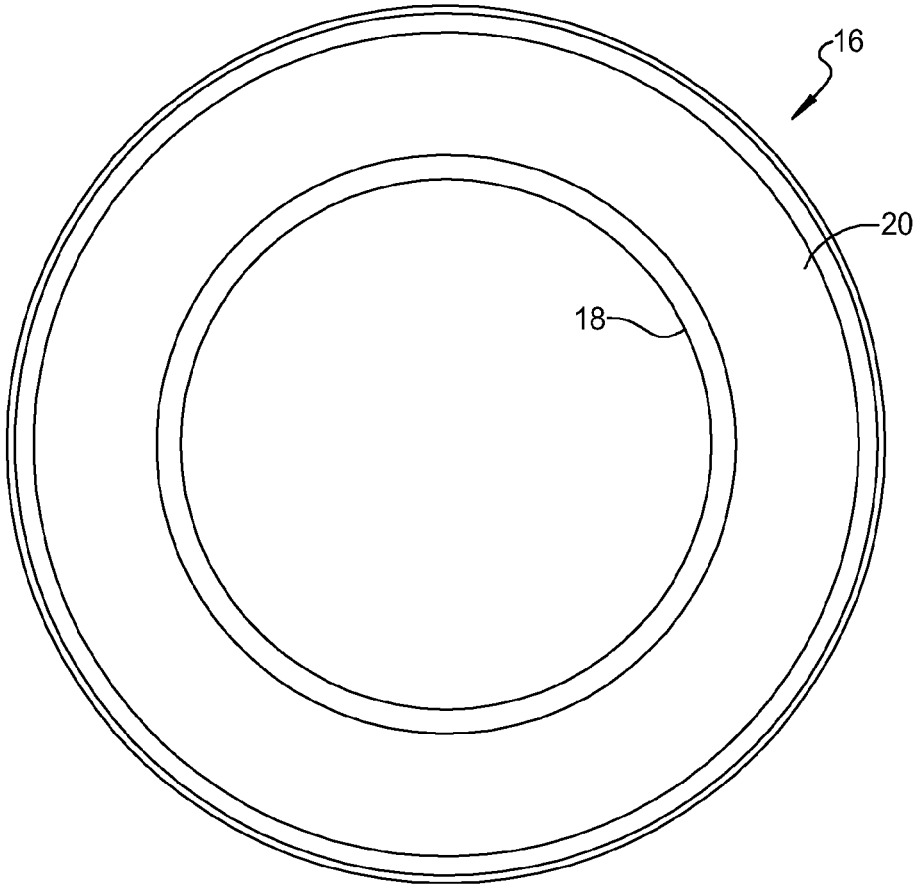
FIG 4

FIG 5
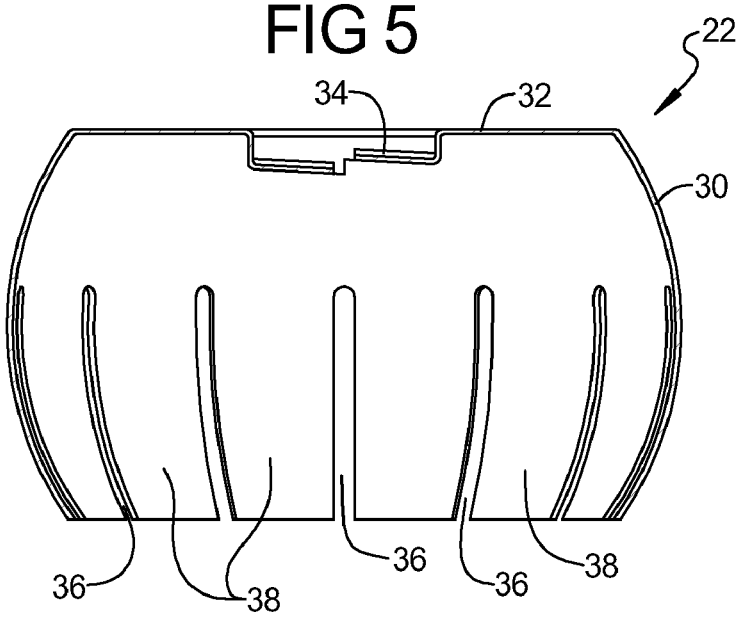
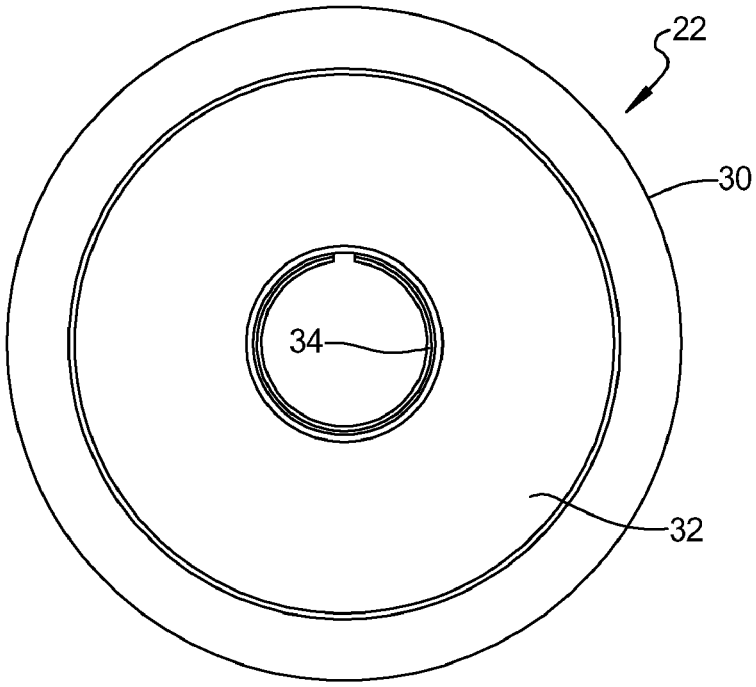
FIG 6

FIG 7
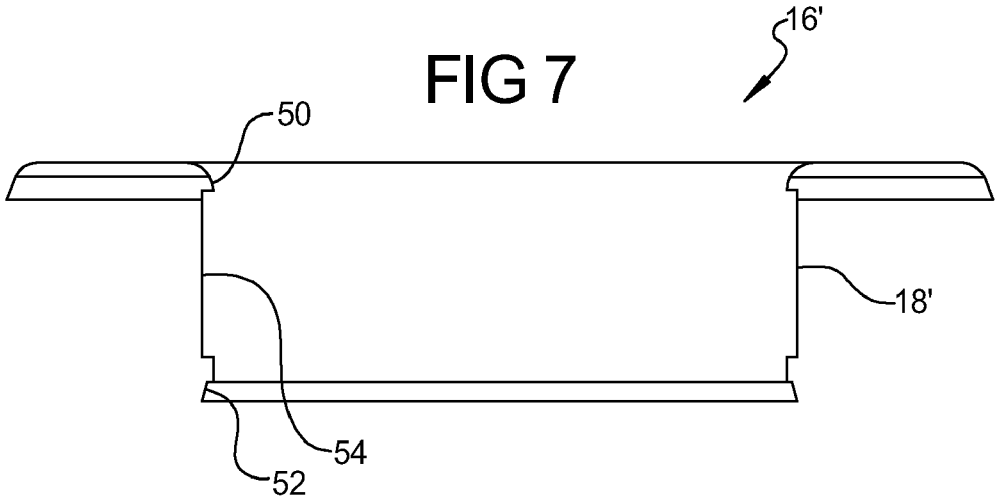
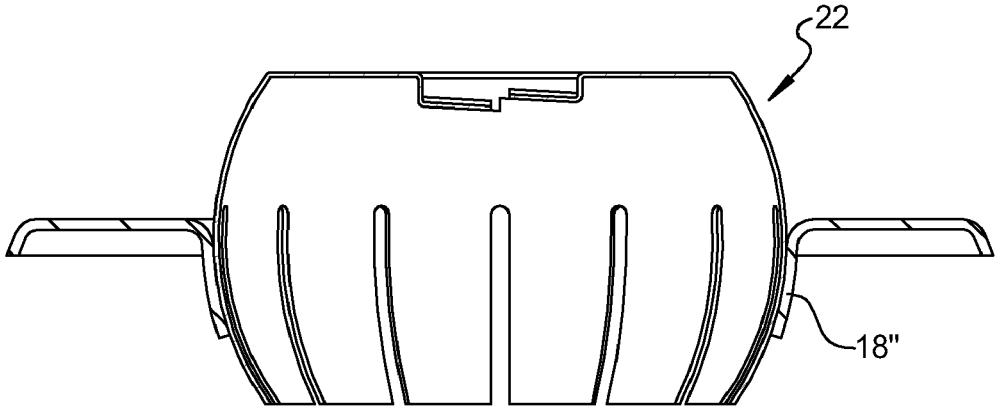
FIG 8

ADJUSTABLE ESCUTCHEON ASSEMBLY FOR A SPRINKLER

FIELD

The present disclosure relates to an escutcheon assembly for mounting a fire sprinkler and more particularly, to an adjustable escutcheon assembly for mounting a fire sprinkler.

BACKGROUND AND SUMMARY

The statements in this section merely provide background information related to the present disclosure and may not constitute prior art.

Fire sprinklers are commonly mounted to the ceilings and sidewalls of residential and commercial buildings. Regulations regarding the mounting of fire sprinklers typically require that sprinklers which are installed in the ceiling must be installed with the deflector and/or central axis parallel to the ceiling. When fire sprinklers are installed at the peak of a slope ceiling, there is no escutcheon available to accommodate the sprinkler to be installed as required.

Accordingly, it is desirable to provide an escutcheon that allows a sprinkler to be mounted as required in a sloped ceiling and that has a refined appearance. Accordingly, the present disclosure provides an adjustable escutcheon assembly for a sprinkler. The escutcheon assembly includes an escutcheon member including a receiver body and an escutcheon flange extending from the receiver body. An adapter member is pivotally received in the receiver body and is adapted to receive a sprinkler therein.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 3 is a side view of an escutcheon member according to the principles of the present disclosure;

FIG. 4 is a top plan view of the escutcheon member according to the principles of the present disclosure;

FIG. 5 is a cross-sectional view of an adapter member according to the principles of the present disclosure;

FIG. 6 is a top plan view of the adapter member according to the principles of the present disclosure;

FIG. 7 is a cross-sectional view of an alternative escutcheon member according to the principles of the present disclosure; and FIG. 8 is a cross-sectional view of an adjustable escutcheon assembly according to a further embodiment of the present disclosure.

DETAILED DESCRIPTION

Figure 1:
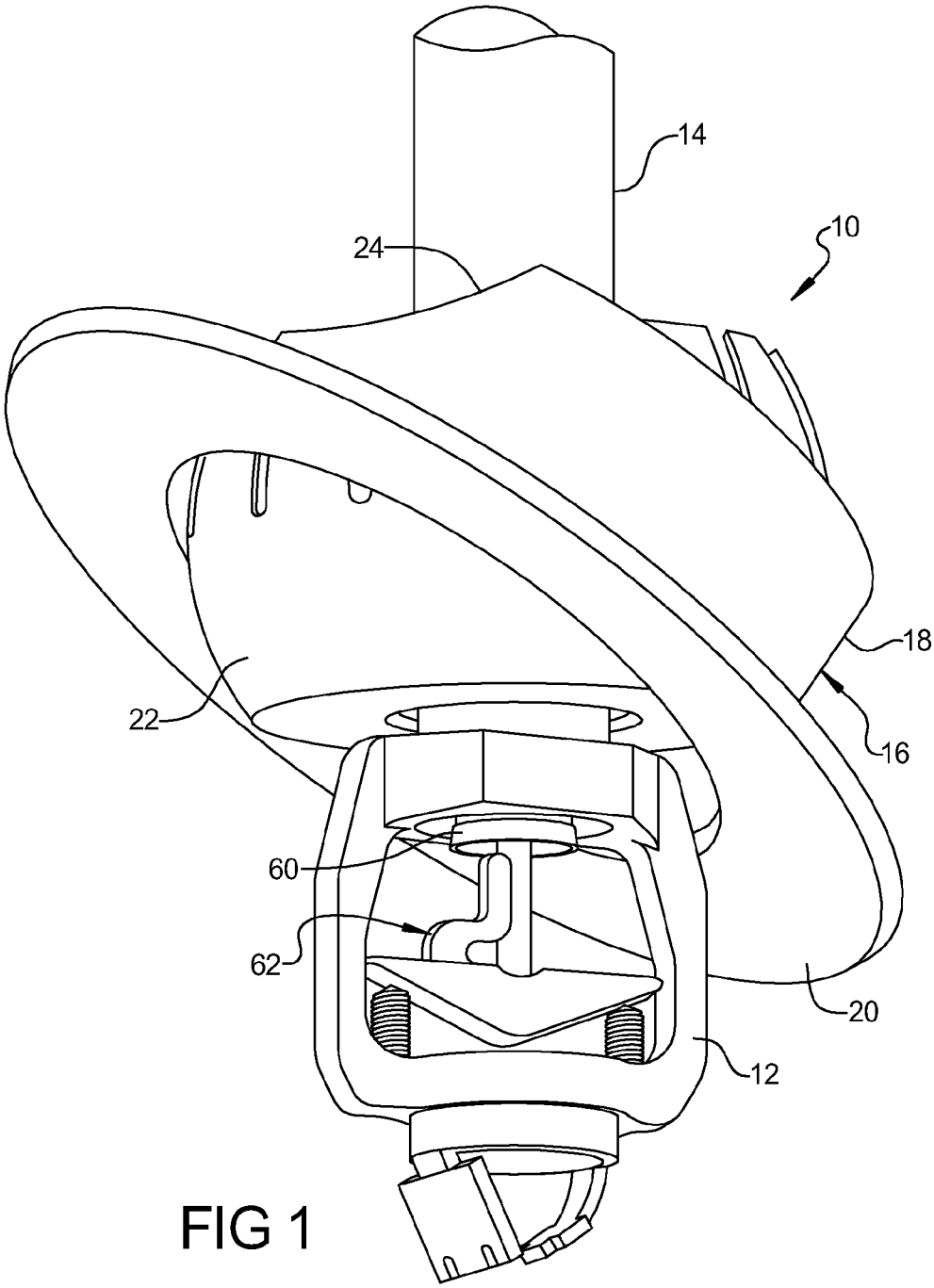
FIG. 1 is a perspective view of a sprinkler mounted to an adjustable escutcheon assembly according to the principles of the present disclosure.
Figure 2:
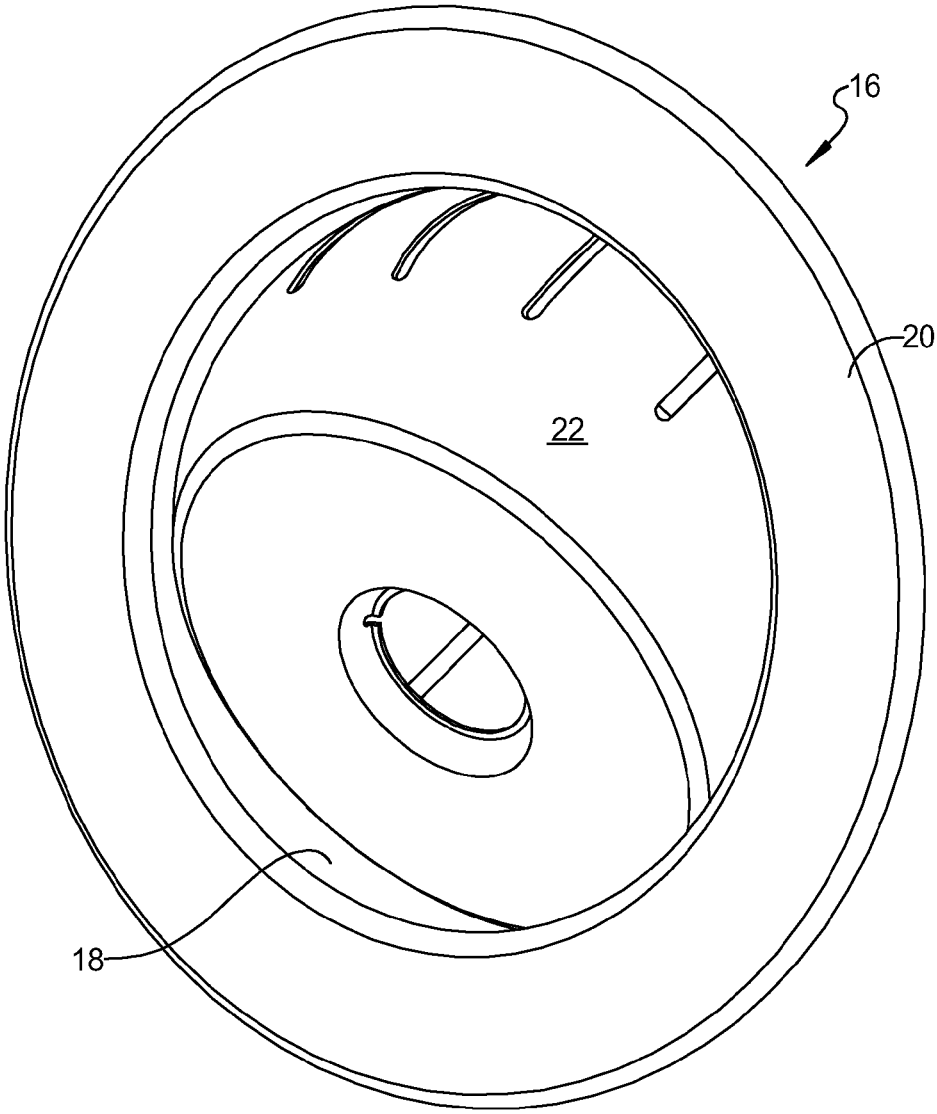
FIG. 2 is a perspective view of the escutcheon assembly with the sprinkler removed.

The following description is merely exemplary in nature and is not intended to limit the present disclosure, application, or uses. It should be understood that throughout the drawings, corresponding reference numerals indicate like or corresponding parts and features.

With reference to FIG. 1, an adjustable escutcheon assembly 10 is shown for mounting a sprinkler 12. The sprinkler 12 is attached to a water supply pipe 14. The escutcheon assembly includes an escutcheon member 16 including a receiver body 18 and an escutcheon flange 20 extending from the receiver body 18. The fire protection sprinkler 12 includes a passage therethrough that is covered by a closure device 60 that is held in place by a heat responsive trigger 62. An adapter member 22 is pivotally received in the receiver body 18. The adapter member 22 is adapted to receive the sprinkler 12 therein.

As illustrated in FIG. 1, the receiver body 18 is generally cylindrical and can include one or more cut out regions 24 which prevent interference with the water supply pipe 14 being connected to the sprinkler 12. With reference to FIG. 3, the inboard end of the cylindrical receiver body 18 can include an outwardly tapered edge 26 that facilitates the insertion of the adapter member into the receiver body 18.

With reference to FIGS. 5 and 6, the adapter member 22 includes an at least partially spherical outer surface 30 and a base portion 32 having a threaded aperture 34 for receiving a sprinkler 12 therein. The at least partially spherical outer surface 30 includes a plurality of slots 36 that define flexible fingers 38. The flexible fingers 38 facilitate the insertion of the adapter member 22 into the receiver body 18 of the escutcheon member 16.

As illustrated in FIG. 7, for larger escutcheon assemblies 16', the receiver body 18' does not need to include the recessed portions 24 since the outer diameter of the receiver body 18' is large enough not to interfere with the attachment of a water supply pipe 14 to the sprinkler 12. As shown in FIG. 7, the cylindrical walls of the receiver body 18' can include inboard and outboard rib portions 50, 52 each having an inner diameter smaller than an inner diameter of an intermediate portion 54 between the inboard and outboard portions so as to provide a cage-type entrapment for the adapter member 22 once forcibly inserted therein.

With reference to FIG. 8, an alternative embodiment is shown wherein the receiver body 18" of the escutcheon member 16" has an at least partially spherical shape that is complimentary to the at least partially spherical shape of the adapter member 22 so as to provide more secure attachment between the escutcheon member 16" and the adapter member 22 to prevent movement therebetween during assembly.

During assembly, the escutcheon member 16 would be inserted in an aperture in a finished wall so that the receiver body 18 extends there through and the escutcheon flange 20 is flush with the finished surface. The sprinkler 12 is mounted to the adapter member 22 which is inserted into the receiver body 18 of the escutcheon member 16 and the sprinkler 12 is attached to the water supply line 14.

With the design of the present disclosure, the adjustable escutcheon assembly 10 allows for a sprinkler 12 to be mounted to a sloped ceiling so that the sprinkler is properly oriented. The adjustable escutcheon assembly 10 allows for a refined appearance of the sprinkler 12 which is mounted as required relative to a sloped ceiling.

What is claimed is:

1. An adjustable escutcheon assembly for mounting a sprinkler, comprising:

an escutcheon member including a receiver body and an escutcheon flange extending from said receiver body; and an adapter member moveably coupled to said receiver body and including a spherically shaped outer surface engaging an inner surface of said receiver body to provide a spherical joint between said escutcheon member and said adapter member, said adapter member being adapted to receive a sprinkler therein, wherein said adapter member has an axis that is angularly adjustable relative to an axis of said receiver body to support the sprinkler generally along said axis of said adapter member and in an angled orientation relative to said axis of said receiver body, wherein said adapter member includes slots extending through said spherically shaped surface to define flexible fingers that are deflected upon insertion of said adapter member into said receiver body.

2. An adjustable escutcheon assembly for mounting a sprinkler, comprising:

an escutcheon member including a receiver body and an escutcheon flange extending from said receiver body;

an adapter member pivotally coupled to said receiver body, said adapter member being adapted to receive a sprinkler therein;

wherein said receiver body is generally cylindrical and includes inboard and outboard portions each having an inner diameter smaller than an inner diameter of an intermediate portion between said inboard and outboard portions; and wherein said adapter member is at least partially spherical and has an outer diameter approximately equal to said inner diameter of said intermediate portion of said receiver body, said adapter member being forcibly inserted and subsequently trapped between said inboard and outboard portions, wherein said adapter member includes a plurality of slots therein that allow said adapter member to be deformed radially inward so as to be received in said receiver body.

3. An adjustable sprinkler mounting assembly, comprising:

an escutcheon member including a receiver body defining a cavity and an escutcheon flange extending from said receiver body;

an adapter member pivotally coupled to said receiver body and positioned within said cavity;

a sprinkler mounted to said adapter member;

wherein said receiver body is generally cylindrical and includes inboard and outboard portions each having an inner diameter smaller than an inner diameter of an intermediate portion between said inboard and outboard portions; and wherein said adapter member is at least partially spherical and has an outer diameter approximately equal or larger than said inner diameter of said intermediate portion of said receiver body, wherein said adapter member includes a plurality of slots therein that allow said adapter member to be deformed radially inward so as to be received in said receiver body.

* * * * *